United States Patent [19]

Germain

[11] Patent Number: 4,909,161

[45] Date of Patent: Mar. 20, 1990

[54] ANTI-POLLUTION AND ANTI-GERM SYSTEM

[76] Inventor: Henri-Paul Germain, 162 de Gentilly Street, West Longueuil, Canada, J4H 1Z3

[21] Appl. No.: 337,464

[22] Filed: Apr. 13, 1989

[51] Int. Cl.[4] ..... F23J 3/00

[52] U.S. Cl. ..... 110/216; 55/94; 55/122; 55/223; 110/162; 110/205; 110/211; 110/215

[58] Field of Search ..... 110/160, 162, 184, 204, 110/205, 210, 211, 215, 216; 55/94, 122, 223

[56] References Cited

U.S. PATENT DOCUMENTS

| | | | |
|---|---|---|---|
| 3,572,264 | 3/1971 | Mercer | 55/223 X |
| 3,668,833 | 6/1972 | Cahill, Jr. | 110/215 X |
| 3,954,381 | 5/1976 | Marecaux | 110/215 X |
| 4,223,614 | 9/1980 | Barkhvius et al. | 110/215 X |
| 4,245,569 | 1/1981 | Fallon, III | 110/215 |
| 4,272,499 | 6/1981 | Cason et al. | 55/94 X |
| 4,305,909 | 12/1981 | Willett et al. | 55/122 X |

*Primary Examiner*—Edward G. Favors

[57] ABSTRACT

A filter apparatus for use with smokestacks, comprising: a smoke collector mounted opposite and spaced from the chimney outlet to collect the smoke emitted from the chimney. A turbine draws the smoke from the collector and feeds it to a circuit where the smoke is first washed by water jets, then by steam jets then again by water jets and is then filtered in an electrostatic filter. If the gases contain living microorganisms, these are killed in a burner. If the gases are not clean enough, they can be recirculated. If the apparatus fails, the gases are safely discharged by the chimney.

6 Claims, 1 Drawing Sheet

ANTI-POLLUTION AND ANTI-GERM SYSTEM

FIELD OF THE INVENTION

This invention relates to filters for removing pollutants from smoke generated by industrial plants.

BACKGROUND OF THE INVENTION

Current environmental preoccupations stress more and more the importance of the quality of the air we breath. It is widely acknowledged that industrial plants, such as those that synthesize chemical compounds or that burn fuels such as coal, produce a large amount of atmospheric pollution that is detrimental to the health of not only the workers at the immediate vicinity of the plant but also the residents of the neighbouring cities.

The Manager of the plant must therefore control the amount of such toxic wastes evacuated into ambient air.

A good analysis of composition of air pollutants found in North America a well as in the Soviet Union is found in a relevant article presented by an Officer of the U.S. government Environmental Protection Agency (EPA) in the August, 1987 edition of the rigorous "Scientific American" magazine. In one graph therein, a curve wa plotted with the X axis representing he diameters of the different particles found in the atmosphere of polluted areas of said regions and with the Y axis representing the relative number of the particles of any given diameter. By inspection, it can be found that the curve is bi-modal, (defining two peaks) with a high concentration of the particles in the air at about 0.1$\mu$ and also at about 10$\mu$ of diameter, Hence, the majority of the particles to be filtered in the air being of different diameters by an order of about 1 to 100, efficient filtering thereof would require more than a single type of filter means, since selective filtering must be used.

The capital costs of installing effective air pollution control implements are however extremely large, and these costs should not of course be such as to hamper the profitability of the business concern running the industrial plant. The problem is to know where to strike the line between the extent of purification of the exhaust smoke from the industrial plant, on one hand, and the capital expenditure required for said purification, on the other hand.

Several types of air-purifying devices have been suggested in the art: a good survey thereof is found in the introductory pages of the Canadian Patent No. 1,060,778 issued Aug. 2, 1979 to Société SACILOR, Acieries et Laminoirs de Lorraine (France). Since installation of such devices is not widespread, it is believed by the present inventor that improvements in this field are desirable.

OBJECTS OF THE INVENTION

An important object of the invention is to increase the safety and efficiency of the filtering apparatuses used in screening pollutants from the gases evacuated from industrial plants via their chimney.

Another object of the invention is to provide a gas filter apparatus for industrial plants which will be economical in manufacturing costs as well as in maintenance thereof.

SUMMARY OF THE INVENTION

In accordance with the objects of the invention, there is disclosed a filter apparatus for use in association with a fume-generating source and with a chimney for said source. The apparatus comprises; a fume collector secured in registry with and spaced above the top outlet of said chimney; a gas scrubbing system; turbine means drawing the smoke from said collector and feeding it to said system, the latter including; first second and third gas-washing means, spacedly mounted in said system for scrubbing said smoke; said first and third washing means each consists of a chamber provided with baffles and a number of water nozzles, fed by a pressurized water source to spray the smoke passing therethrough; said second washing means located intermediate the first and third washing means and consisting of a number of steam nozzles, fed by a pressurized steam source to spray the smoke. Filters including an electrostatic filter are mounted downstream of each gas washing means.

Advantageously, said collector has an inlet which has a larger cross-sectional area than that of said chimney top outlet. Profitably, a bypass tube communicates said source directly with said turbine means. There may also be further included a burner chamber, mounted downstream of said electrostatic filter, for burning particulate matters and micro-organisms remaining in said smoke.

Means are provided to recirculate the purified gases through the scrubbing system.

It is envisioned that said pressurized water source could include: a water pump; a reservoir, upwardly opening into said scrubbing chambers for collecting the spent water; sedimentation means in said reservoir for separating the solid particles in said spent water; and piping means interconnecting the bottom of said reservoir serially with said pump and water nozzles; whereby a closed circuit is thereby defined for the water. Means could then be added to return the condensed steam discharged from said steam nozzles into said reservoir.

BRIEF DESCRIPTION OF THE DRAWINGS

The FIGURE shows a schematic view of a filtering apparatus according to a preferred embodiment of the invention, connected to a chimney of an industrial plant.

DETAILED DESCRIPTION OF THE PREFERRED EMBODIMENT OF THE INVENTION

Figure 1:
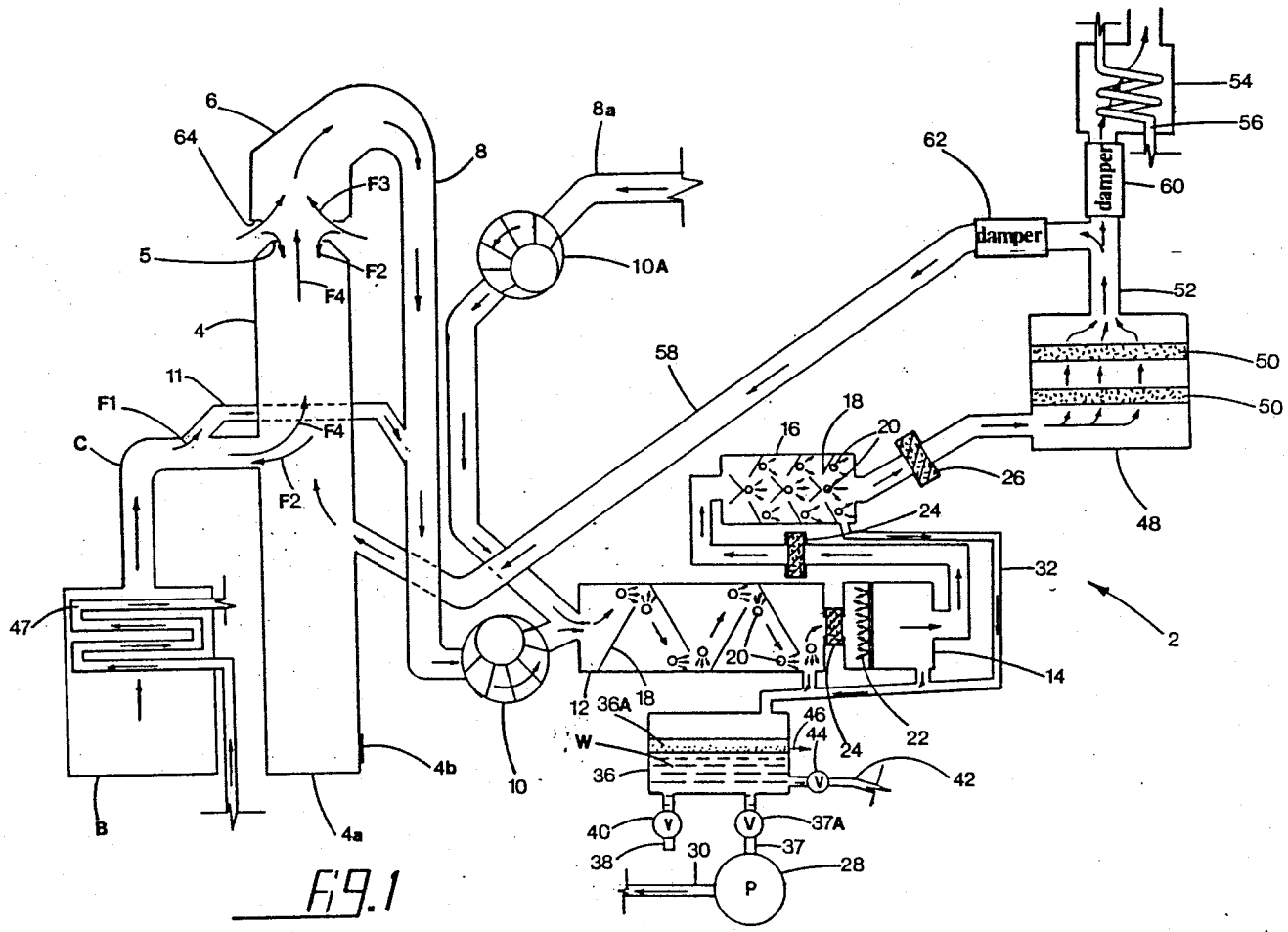

The air filtering apparatus of the invention, denoted by numeral 2, is to be operatively connected to a conventional upright chimney. 4, which is closed at its base 4a except for a normally closed cleaning opening 4b and provided with a top outlet 5. The smoke emanating from a plant boiler B and to be filtered, may enter chimney 4 by a duct C.

A fume collector 6 is located downstream of the top outlet port 5 of the chimney 4, in longitudinal register therewith and spacedly therefrom. A pipe 8 connects collector 6 to a gas turbine or blower 10. A by-pass duct 11 by-passes chimney 4 by connecting duct C upstream of the chimney to duct 8 upstream from fan 10. The latter feeds the gases to a scrubbing system composed of three serially connected scrubbing chambers 12, 14 and 16. In chambers 12 and 16, baffles 18 create turbulence in the gases which are washed by water jets 20. In the intermediate chamber 14, steam jets 22 are directed in counterflow. Gas filters 24 are located downstream of chambers 12 and 14 while chamber 16 is followed by an electrostatic filter 26.

Water nozzles 20 are fed by recirculated water W. They are all operatively connected to the outlet of a single water pump 28 through a hose 30. Drain tubing 32 connects chambers 12, 14 and 16 to a large reservoir 36 provided with a drawer 36A into which the water W sprayed by nozzles 20 and condensed from nozzles 22 will be collected. The drawer 36A overflows into the bottom section of reservoir 36. The bottom of reservoir 36 operatively communicates with the inlet of water pump 28 via an outlet pipe 37 having a cut-off valve 37A. A drain 38 with a control valve 40 is provided to reservoir 36, to empty and clean the same. Make-up water can be fed to reservoir 36 by a pipe 42 connected to a tap water source and normally closed by valve 44. Make-up water is admitted when the water level in the bottom section of reservoir 36 falls below a certain level by evaporation.

The solids in the fumes are washed by water jets 20 and steam jets 22 and collect at the bottom of drawer 36A which can be removed for cleaning (arrow 46).

The source of steam for nozzles 22 may be a steam generator 47 of boiler B or any other steam supply.

The downstream end of filter 26 is connected to a large burner chamber 48 where the gas flows through fuel fed flames 50.

The outlet of chamber 48 is connected through duct 52 to an outlet chamber 54 open to atmosphere and provided with a heat exchanger tube 56 for heating the water W if necessary, by the hot gases coming from burner chamber 48. Preferably a return duct 58 connects duct 52 with chimney 4 below the entry of duct C into chimney 4. Dampers 60 and 62 are used to selectively close ducts 52 and 58. Additional sources of smoke to be filtered can be connected to pipes 8A and sucked by a gas turbine 10A similar to turbine 10 directly into scrubber chamber 12. A primary washing of the polluted gases is effected by water jets 20 in chamber 12 whereby the major portion of the solids is removed. The following steam washing by steam jets 22 and water washing in chamber 16 filtering by filters 24 and by electrostatic filter 26 removes practically all solids. The solids washed away are collected in drawer 36A. Any living micro-organism remaining in suspension in the gases downstream of filter 26, are burnt in burner chamber 48. Therefore, the gases are normally practically free of any contaminants and can be discharged to atmosphere through outlet box 54 by opening damper 60 and closing damper 62.

However the purified gases can be recycled by duct 58 for repeated washing, filtering, and burning.

Collector 6 defines a mouth 64 which is spaced from and is diametrally larger than chimney outlet 5, say by about twenty-five percent.

In the normal operation of boiler B emitting a predetermined amount of polluted gases, fan 10 has sufficient capacity to draw the gases from duct C through by-pass duct ? 1 (arrow F1) while also drawing atmospheric air at chimney outlet 5 down through the chimney 4 (arrow F2) and up through collector 6 and down duct (arrows F3). The atmospheric air dilutes the polluted gases to be treated but not sufficiently to affect the purification process. If boiler B temporarily increases its output of polluted gases, the latter will flow not only through duct 11 (arrow F1) but also upwardly of chimney 4 (arrow F4) into collector 6 and down duct 8. In this case air flow F2 down the chimney stops The excess polluted gases are collected by collector 6 to be purified. The flow of atmospheric air previously entering collector 6 at F3 can decrease to zero. If the boiler gas output increases still more, or if the apparatus 2 becomes blocked or the blower 10 fails, the boiler gases will simply escape to the atmosphere at the chimney outlet 5.

Thus the system is completely safe since there cannot be any pressure build-up in boiler B or in ay part of apparatus 2.

I claim:

1. An apparatus for the purification of polluted gases emitted by a polluted gas emitting source connected by a first duct to a chimney having a top outlet, comprising in combination with said first duct and chimney, a fume collector mounted on top of said chimney and having an inlet facing and spaced from said chimney outlet, a gas circulating turbine having an inlet, a second duct connected to said turbine inlet and to said collector, a gas purifiying means connected to the outlet of said turbine, and a by-pass duct by-passing said chimney and communicating said first duct upstream of said chimney and said second duct, said turbine having a gas circulating capacity for a predetermined polluted gas output of said source, sufficient to draw atmospheric air downwardly through said chimney from its top outlet and through said collector and second duct.

2. An apparatus as defined in claim 1, wherein said gas purifiying means includes at least three serially connected gas scrubbing chambers, the first and last chambers provided with gas deflecting baffles and water jets, the second chamber having steam jets.

3. An apparatus as defined in claim 2, further including a gas filter at the outlet of each chamber.

4. An apparatus as defined in claim 3.

wherein the gas filter at the outlet of said third chamber is an electrostatic filter.

5. An apparatus as defined in claim 4.

further including furnace means to heat to a high temperature the gases issuing from said electrostatic filter.

6. An apparatus as defined in claim 5.

further including means to selectively discharge to atmosphere and to return to said chimney, the gases issuing from said furnace means.

* * * * *